US005898350A

United States Patent [19]

Aberasturi

[11] Patent Number: 5,898,350

[45] Date of Patent: Apr. 27, 1999

[54] RADIATING COAXIAL CABLE AND METHOD FOR MAKING THE SAME

[75] Inventor: Thomas F. Aberasturi, Wallingford, Conn.

[73] Assignee: Radio Frequency Systems, Inc., Marlboro, N.J.

[21] Appl. No.: 08/969,663

[22] Filed: Nov. 13, 1997

[51] Int. Cl.[6] ..... H01Q 13/20; H01P 3/06

[52] U.S. Cl. ..... 333/237; 343/770

[58] Field of Search ..... 333/237; 174/121 A; 343/770

[56] References Cited

U.S. PATENT DOCUMENTS

| | | | |
|---|---|---|---|
| 3,963,999 | 6/1976 | Nakajima et al. | 333/237 |
| 4,152,648 | 5/1979 | Delogne | 333/237 X |
| 4,157,518 | 6/1979 | McCarthy | 333/237 |
| 4,322,699 | 3/1982 | Hildebrand et al. | 333/237 |
| 4,325,039 | 4/1982 | Allebone | 333/237 |
| 4,339,733 | 7/1982 | Smith | 333/237 |
| 4,366,457 | 12/1982 | Bode et al. | 333/237 |
| 4,625,187 | 11/1986 | Bocher | 333/237 |
| 4,780,695 | 10/1988 | Watari et al. | 333/237 |
| 4,800,351 | 1/1989 | Rampalli et al. | 333/237 |
| 5,276,413 | 1/1994 | Schulze-Buxloh | 333/237 |
| 5,291,164 | 3/1994 | Levisse | 333/237 |
| 5,339,058 | 8/1994 | Lique | 333/237 |
| 5,422,614 | 6/1995 | Rampalli et al. | 333/237 |
| 5,467,066 | 11/1995 | Schulze-Buxloh | 333/237 |

FOREIGN PATENT DOCUMENTS

| | | | |
|---|---|---|---|
| 5-235611 | 9/1993 | Japan | 333/237 |

*Primary Examiner*—Paul Gensler

*Attorney, Agent, or Firm*—Ware, Fressola, Van Der Sluys & Adolphson LLP

[57] ABSTRACT

In a radiating coaxial cable, the outer-conductor having a plurality of radiating apertures is wrapped in a tape of conducting material which covers some of the apertures. In one embodiment of the invention, the conductive tape is combined with a fire retardant tape so that one winding procedure will result in winding both the conductive tape and the fire retardant tape over the outer-conductor.

20 Claims, 4 Drawing Sheets

RADIATING COAXIAL CABLE AND METHOD FOR MAKING THE SAME

BACKGROUND OF THE INVENTION

1. Field of the Invention

The present invention relates generally to coaxial cables. More particularly, the present invention relates to coaxial cables which permit the signal carried by the cable to radiate through apertures in the outer conductor.

2. Discussion of Related Art

In the prior art, coaxial cables are formed by disposing an inner-conductor within a dielectric material. The dielectric material and inner-conductor are disposed within an outer-conductor. The dielectric material is usually a foam material, but may be air. The outer-conductor is typically covered by an outer jacket.

Radiating coaxial cables are designed so as to permit the signal carried by the radiating coaxial cable to radiate through one or more apertures formed in the outer-conductor. For example in a patent issued to Allebone (U.S. Pat. No. 4,325,039), circular apertures are formed in the outer conductor. Another example of a radiating coaxial cable is provided by U.S. Pat. No. 5,339,058 issued to Lique which discloses a coaxial cable with a slot in the outer-conductor for radiating the signal carried by the coaxial cable.

A common requirement of radiating coaxial cable is resistance to flame propagation. In radiating coaxial cable having a foam dielectric, flame propagation may be encouraged if the dielectric melts and escapes through the radiating apertures. In order to provide the necessary fire protection, radiating coaxial cables employ a fire retardant material in the outer jacket. Other prior art designs employ a barrier tape, installed between the outer-conductor and the outer jacket or between the dielectric material and the outer-conductor, which contains the foam dielectric at melt temperatures. Examples of coaxial cables using barrier tape are found at U.S. Pat. Nos. 4,800,351 and 5,422,614 issued to Rampalli et al.

In the case where the outer-conductor of a radiating coaxial cable is corrugated, it is common to form the radiating apertures in the outer-conductor by passing the outer-conductor through a milling machine which removes part of the outer-conductor in order to form a radiating aperture. In a continuous milling process, the milling tool is positioned at a fixed distance from the center-line of the outer-conductor, and the outer-conductor is fed axially into the milling machine so that as the crests of the corrugations pass by the milling tool, a series of oval apertures are produced in the crest of each corrugation of the outer-conductor. U.S. Pat. No. 5,422,614 discloses a corrugated outer-conductor having oval apertures in the corrugation crests which may have been produced via the continuous milling process.

In the continuously milled, corrugated outer conductor, the apertures are spaced apart according to the spacing of the corrugations. However, in some applications, this aperture spacing is not desirable. As compared to an intermittently milled cable that does not have apertures at every corrugation, the continuously milled cable has a larger attenuation of the signal for a desired coupling loss. Also, continuously milled cables have a larger direct current resistance for a desired coupling loss than intermittently milled cables.

On the other hand, coaxial cable formed by intermittently milling the outer-conductor tends to have voltage standing-wave ratio ("VSWR") spikes. Intermittently milled coaxial cable is also more expensive to manufacture than continuously milled radiating coaxial cable, especially when the spacing between apertures is not constant, which is sometimes required in order to control VSWR spikes.

SUMMARY OF THE INVENTION

Accordingly, it is an object of the present invention to provide a radiating coaxial cable.

In addition, it is an object of the present invention to provide an intermittently radiating coaxial cable with a continuously milled, corrugated outer-conductor.

It is another object of the present invention to provide an intermittently radiating coaxial cable which has low signal attenuation for a given coupling loss.

It is also an object of the present invention to provide an intermittently radiating coaxial cable which has low direct current resistance for a given coupling loss.

The foregoing objectives are realized by the radiating coaxial cable of the present invention which includes an inner-conductor, a dielectric material disposed about the inner-conductor, an outer-conductor having radiating apertures disposed about the dielectric material. According to the present invention, at least a portion of one of the radiating apertures of the outer-conductor is covered by a conductive material, in the form of a tape, to reduce the quantity of radiation emitted from the so covered aperture.

Other objects and advantages of the present invention will become apparent to those skilled in the art from the following detailed description read in conjunction with the attached drawings and claims appended hereto.

BRIEF DESCRIPTION OF THE DRAWINGS

The drawings, not drawn to scale, include.

DETAILED DESCRIPTION OF THE INVENTION

Figure 1:
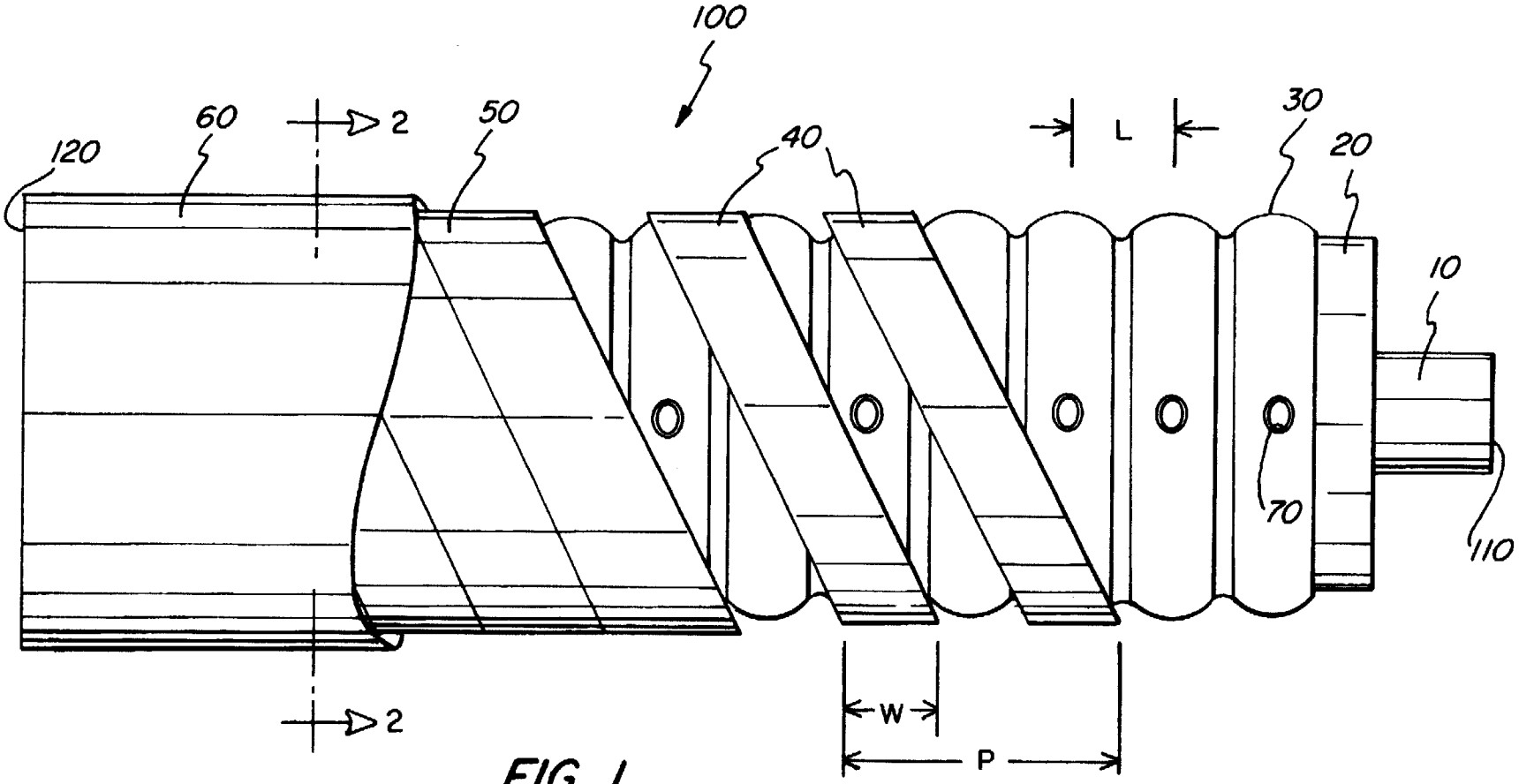
FIG. 1, which is a side view of an embodiment of the present invention with successive components of the cable cut away.

FIG. 1 shows an embodiment of the present invention wherein a section of a coaxial cable 100 having a near end 110 and a far end 120, is shown with each component of the coaxial cable 100 cut away in successive layers. The coaxial cable 100 is formed by an inner-conductor 10, a dielectric material 20 disposed about the inner-conductor 10, an outer-conductor 30 which is disposed about the dielectric spacer 20. Each of the outer corrugations of the outer-conductor 20 has an aperture 70 milled therein. The axial distance or spacing between adjacent apertures is L. The above described structure forms the basic structure of a well known continuously milled radiating coaxial cable.

Figure 2:
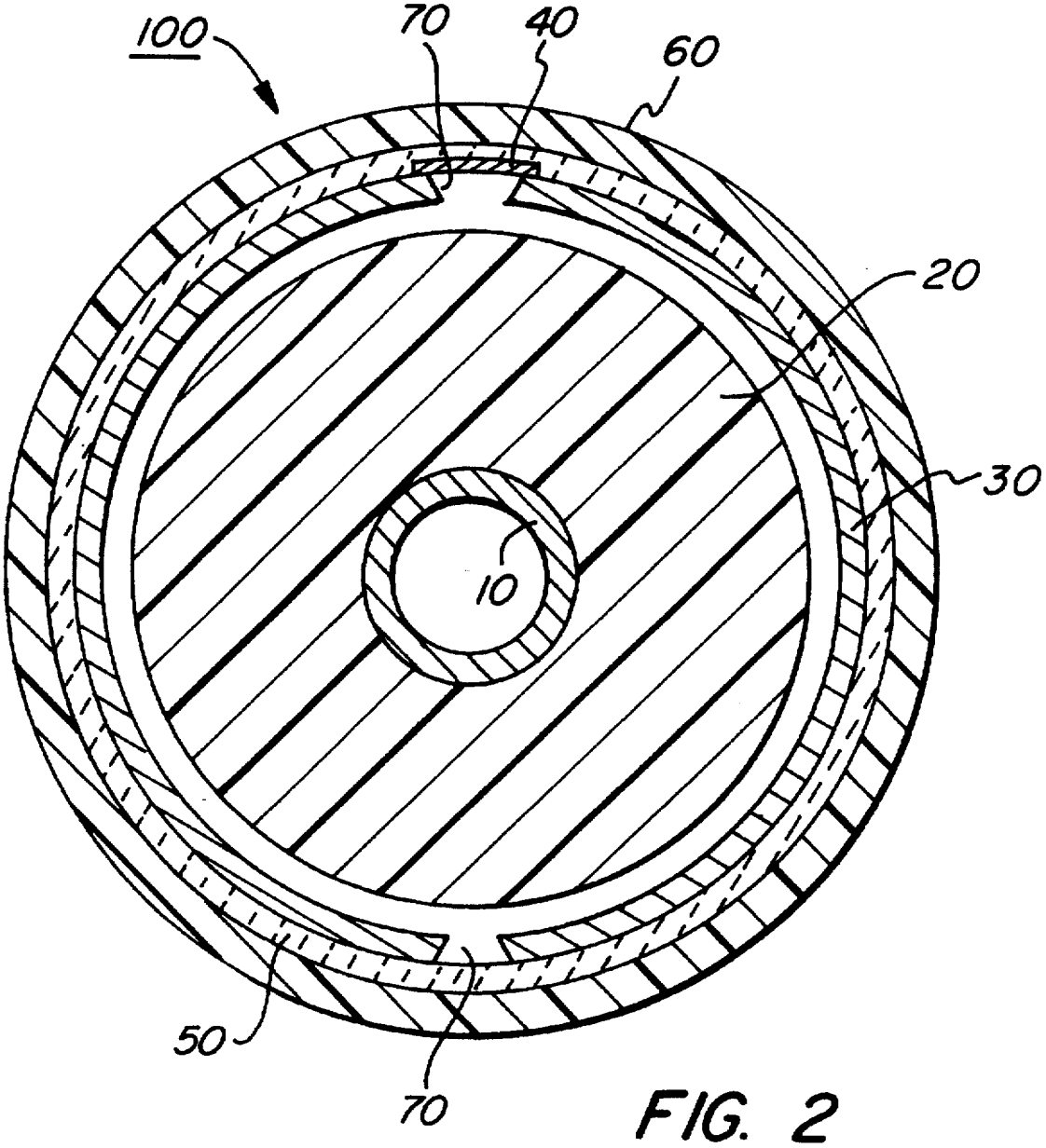
FIG. 2, which is a cross sectional view of an embodiment of the present invention taken along the line 2—2 of FIG. 1.
Figure 4:
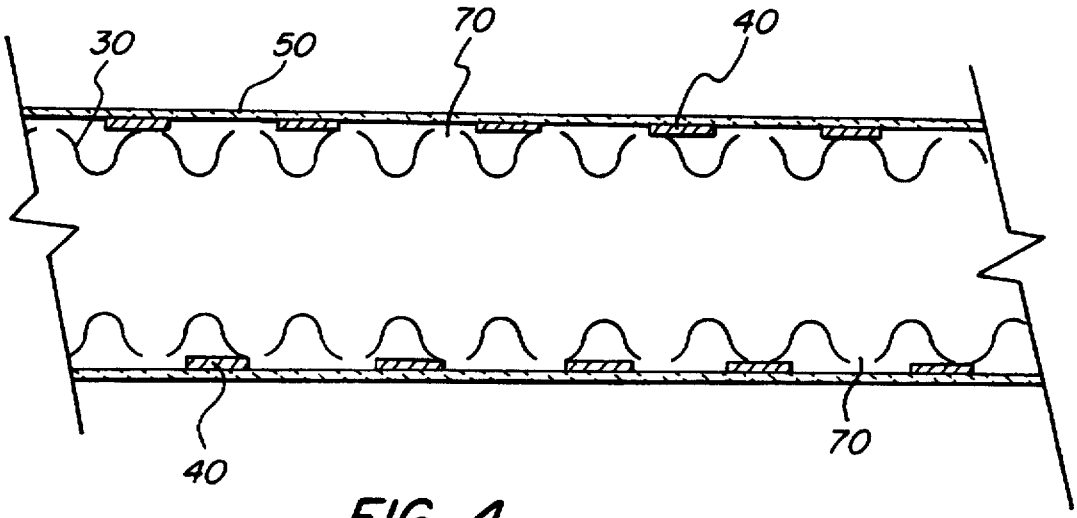
FIG. 4, which is a cross sectional view of an embodiment of the present invention where the conductive tape partially covers radiating apertures.

Referring to FIGS. 1 and 2, according to the present invention, an intermittent radiating cable can be formed from a cable having a continuously milled, corrugated outer conductor, or any other type of outer conductor, by wrapping the outer-conductor 30 with a conductive tape 40 so that the conductive tape 40 covers at least a portion of one or more of the radiating apertures 70. Conductive tape 40 is preferably comprised of the same metal, such as copper, as the outer conductor. In a portion of the embodiment illustrated in FIG. 1, every other radiating aperture 70 is completely covered by the conductive tape 40. In a portion of the embodiment, the axial distance or spacing between uncovered apertures is twice L. Although FIG. 1 shows the conductive tape 40 completely covering radiating apertures 70, the present invention may be practiced by partially covering radiating apertures 70, as shown in FIG. 4, to limit the amount of radiation emitted therefrom.

As those skilled in the art will now appreciate, the desired coverage of the apertures may be controlled by selecting the width W of the conductive tape 40 and the wrapping pitch P. For example, instead of covering every other radiating aperture 70 as shown in FIG. 1 so that the distance between uncovered apertures is twice L, the width W of the conductive tape 40 and the wrap pitch P can be selected so that three consecutive radiating apertures 70 are covered by the width W of the conductive tape 40, and that the next three consecutive radiating apertures 70 are not covered by the conductive tape 40. In such an alternative embodiment, a group of three apertures would be separated from an adjacent group of three apertures by an axial distance which is four L.

The wrap pitch P may also be varied along the length of the coaxial cable 100 from the near end 110 to the far end 120. In such an embodiment, the pitch P of the conductive tape wrap may be designed to cover more radiating apertures towards the near end of the coaxial cable 100 which may be located adjacent to a signal transmission source, and to cover less radiating apertures at the far end 120 of the coaxial cable 100 which is furthest from the signal transmission source.

To provide fire retardancy to the cable, a fire-retardant tape 50 is wrapped or laid over the outer-conductor 30 and the conductive tape 40. The fire-retardant tape 50 is preferably comprised of mica. Alternatively, the outer-conductor can be wrapped with the flame-retardant tape 50 prior to wrapping the conductive tape about the outer-conductor. While the conductive tape 40 need not be in electrical contact with the outer-conductor 30, electrical contact between the conductive tape 40 and the outer-conductor 30 is desirable because it provides the cable with a lower DC resistance. After the fire retardant tape and the conductive tape are applied, an outer-jacket 60 is extruded thereover to protect the underlying cable structure.

Figure 3:
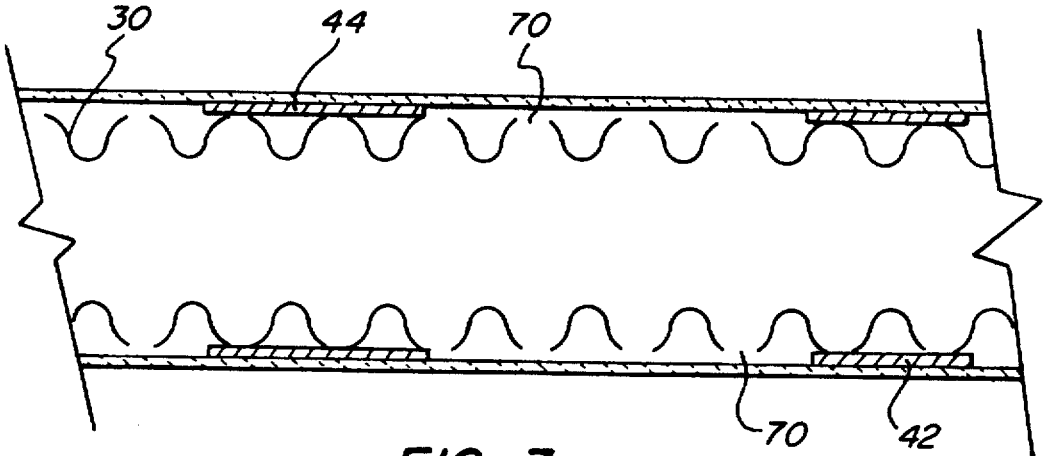
FIG. 3, which is a cross sectional view of an embodiment of the present invention having the conductive tape wrapped annularly.

In FIGS. 1 and 4, the conductive tape 40 is shown helically wrapped around the outer-conductor 30. However, in an alternative embodiment shown in FIG. 3, the conductive tape 40 can also be applied in annular sections or sleeves 42 and 44 to cover as many or as few apertures 70 as desired with a predetermined spacing or distance between covered or uncovered apertures.

Furthermore, although FIG. 1 shows the conductive tape 40 wrapped around an annularly corrugated outer-conductor 30, those skilled in the art will now appreciate that the present invention may be easily practiced with a cable having a helically corrugated outer-conductor or a cable having a smooth outer-conductor. Additionally, although FIG. 1 shows the present invention with radiating apertures on one side of the coaxial cable 100, the present invention can be practiced as shown in FIG. 4 with a coaxial cable having radiating apertures positioned anywhere on the crest of a corrugation.

Figure 5B:
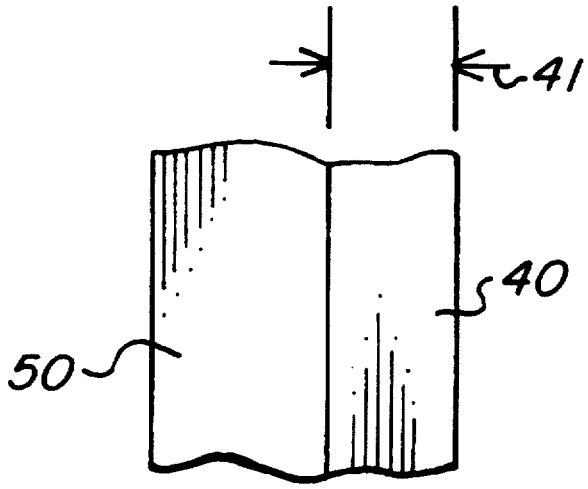
FIG. 5B, which is a top view of the tape illustrated in FIG. 5A.
Figure 5C:
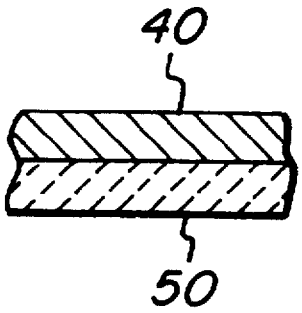
FIG. 5C which is a cross sectional view of another tape which may be employed in the present invention.
Figure 5A:
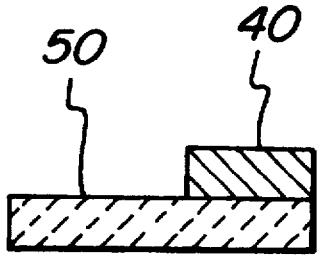
FIG. 5A, which is a cross sectional view of the conductive and fire retardant tape employed in the present invention.

The wrapping of the conductive tape and the fire retardant tape may be performed in a single operation by attaching the conductive tape 40 to the fire-retardant tape 50 to form a single tape (shown in FIGS. 5A through 5C) or by metallizing a portion of the fire retardant tape. As illustrated in FIGS. 5A and 5B, a portion of the fire retardant tape 50 has the conductive tape attached thereto. While the fire retardant tape needs to completely wrap the outer-conductor, the conductive tape coverage may be controlled by varying the width Wc of the conductive tape relative to the width Wr of the fire retardant tape. The combined, single tape is then wrapped around the outer-conductor in the same manner employed for wrapping the fire retardant tape or the conductive tape alone.

The present invention enables the variation of the radiation pattern of a radiating coaxial cable having a continuously milled outer-conductor. Although the present invention has been described with respect to multiple embodiments, it will be understood that other embodiments of the present invention may be made without departing from the spirit and scope of the present invention. Hence, the present invention is deemed limited only by the appended claims and the reasonable interpretation thereof.

What is claimed is:

1. A radiating coaxial cable, the cable comprising:

an inner-conductor;

a dielectric material disposed about the inner-conductor;

an outer-conductor having a plurality of radiating apertures, the outer-conductor being disposed about the dielectric material; and a conductive tape disposed about a portion of the outer-conductor, wherein the disposition of the conductive tape covers at least a portion of one radiating aperture.

2. The coaxial cable of claim 1, wherein the conductive tape completely covers at least one radiating aperture.

3. The coaxial cable of claim 2, further comprising a fire-retardant material covering the outer-conductor and the conductive tape.

4. The coaxial cable of claim 3, wherein an outer jacket is disposed about the outer conductor and the fire-retardant tape.

5. The coaxial cable of claim 1, wherein the conductive tape is wrapped about the outer-conductor so as to completely cover at least two adjacent apertures of the plurality.

6. The coaxial cable of claim 5, further comprising a fire-retardant material covering the outer-conductor and the conductive tape.

7. The coaxial cable of claim 6, wherein an outer jacket is disposed about the outer conductor and the fire-retardant tape.

8. The coaxial cable of claim 1, wherein the conductive tape is wrapped about the outer-conductor so as to leave at least two adjacent apertures of the plurality uncovered.

9. The coaxial cable of claim 8, further comprising a fire-retardant material covering the outer-conductor and the conductive tape.

10. The coaxial cable of claim 9, wherein an outer jacket is disposed about the outer conductor and the fire-retardant tape.

11. A radiating coaxial cable having a near end and a far end, the cable comprising:

an inner-conductor;

a dielectric material disposed about the inner-conductor;

an annularly corrugated outer-conductor, wherein each of the annular corrugations has at least one radiating aperture therethrough;

a conductive tape disposed about at least a portion of the outer-conductor, wherein the disposition of the conductive tape covers at least a portion of one radiating aperture;

a fire retardant tape disposed about the conductive tape and annularly corrugated outer-conductor; and an outer jacket disposed about the fire retardant tape.

12. The coaxial cable of claim 11, wherein the conductive tape completely covers at least one radiating aperture.

13. The coaxial cable of claim 11, wherein the conductive tape is wrapped about the outer-conductor so as to completely cover at least two adjacent apertures of the plurality.

14. The coaxial cable of claim 11, wherein the conductive tape is wrapped about the outer-conductor so as to leave at least two adjacent apertures of the plurality uncovered.

15. A method for making a radiating coaxial cable, the method comprising the steps of:

(a) providing an inner conductor;

(b) disposing a dielectric material about the inner-conductor;

(c) disposing an outer-conductor having a plurality of radiating apertures about the dielectric material; and (d) wrapping a conductive tape over a portion of the outer-conductor so as to cover at least a portion of one radiating aperture.

16. The method of claim 15, wherein the conductive tape is wrapped over a portion of the outer-conductor so as to completely cover at least one radiating aperture.

17. The method of claim 15, wherein the conductive tape is wrapped about the outer-conductor so as to completely cover at least two adjacent apertures of the plurality.

18. The method of claim 15, wherein the conductive tape is wrapped about the outer-conductor so as to leave at least two adjacent apertures of the plurality uncovered.

19. The method of claim 15, further comprising the step of:

(e) wrapping a flame-retardant tape over the portion of the outer conductor covered by the conductive tape wrapped about the outer-conductor.

20. A method for making a radiating coaxial cable, the method comprising the steps of:

(a) providing an inner conductor;

(b) disposing a dielectric material about the inner-conductor;

(c) disposing an outer-conductor having a plurality of radiating apertures about the dielectric material; and (d) wrapping a flame-retardant tape having a conductive material applied thereto over a portion of the outer-conductor so as to cover at least a portion of one radiating aperture with the conductive material.

* * * * *